United States Patent [19]

Nath

[11] Patent Number: 4,912,742

[45] Date of Patent: Mar. 27, 1990

[54] USE OF MICROWAVE ENERGY FOR METHOD AND APPARATUS FOR KILLING ELECTRONIC BUGS EMBEDDED IN CONCRETE AND BUILDING STRUCTURES

[76] Inventor: Robert H. Nath, 11709 Barrington Way, Austin, Tex. 78759

[21] Appl. No.: 193,064

[22] Filed: May 12, 1988

[51] Int. Cl.[4] ..... H05B 6/64

[52] U.S. Cl. ..... 219/10.55 M; 219/10.55 R

[58] Field of Search ..... 219/10.55 R, 10.55 A, 219/10.55 M, 10.55 D; 361/424; 174/35 R

[56] References Cited

U.S. PATENT DOCUMENTS

| | | | |
|---|---|---|---|
| 4,370,534 | 1/1983 | Brandon | 219/10.55 A |
| 4,609,104 | 9/1986 | Kasper et al. | 174/35 R X |
| 4,778,970 | 10/1988 | Klaila | 219/10.55 A |

*Primary Examiner*—Philip H. Leung

*Attorney, Agent, or Firm*—Ronald R. Snider

[57] ABSTRACT

An apparatus and method of destroying electronic surveillance devices inside building structures by the use of radio frequency energy is shown and described. Microwave energy is generated by a magnetron and directed to the building structure either by continuous waves of by short bursts of energy.

20 Claims, 1 Drawing Sheet

FIG. 1
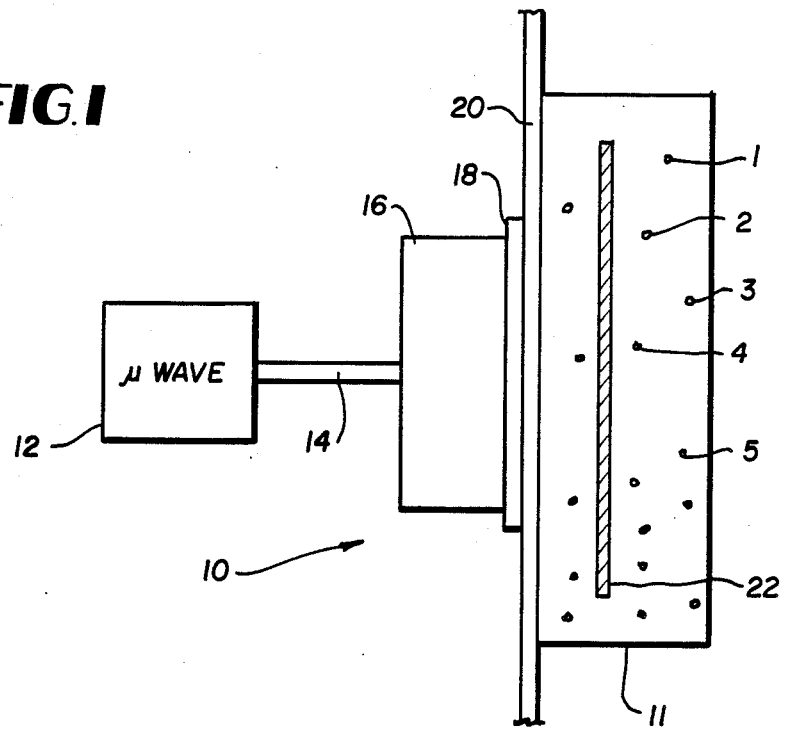
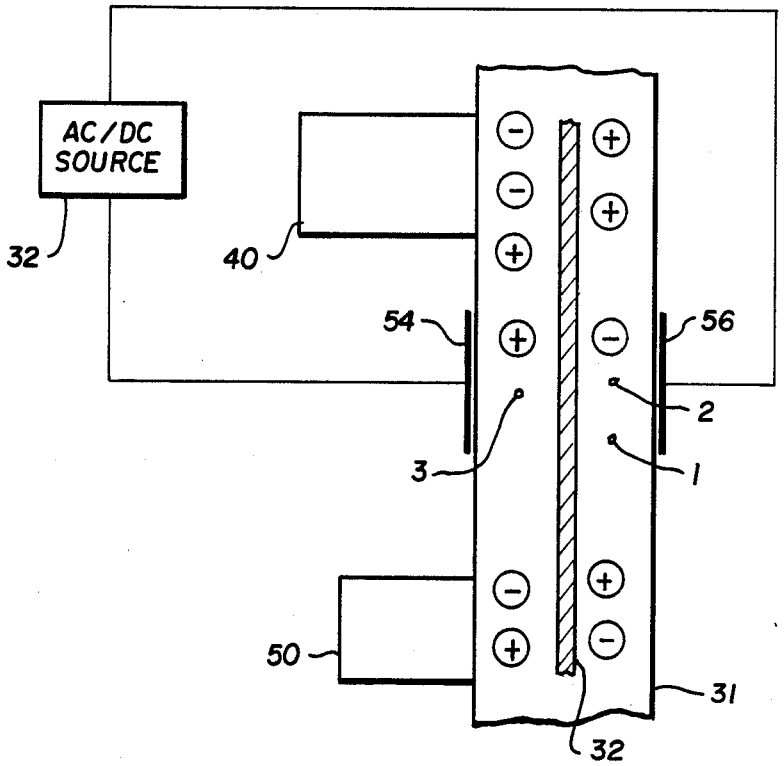
FIG. 2

USE OF MICROWAVE ENERGY FOR METHOD AND APPARATUS FOR KILLING ELECTRONIC BUGS EMBEDDED IN CONCRETE AND BUILDING STRUCTURES

BACKGROUND OF THE INVENTION (1) Field of the invention:

This invention is for killing electronic bugs which have been placed in structures of buildings. In the case of the United States embassy in Moscow, it is known that during construction a substantial number of electronic bugs of different types were placed in the building structure during its construction. Specifically it is known that listening devices are placed in the structural concrete of the building.

This has resulted in a strain on international relations between the United States and Russia. The United States has not taken possession of the new Moscow embassy, and has not permitted the Russians to begin occupancy of their new embassy building located on Wisconsin Avenue in the District of Columbia until such time as the U.S. can occupy the Moscow embassy. It has been reported in the press that the concrete in the new Moscow embassy contains a large number of bugs, and that if a solution is not found to the problem, it will be necessary to tare the building down to the ground and reconstruct a new one where there are no bugs in the concrete. The expense will obviously be substantial, and the time during which reconstruction takes place will delay the Russian occupancy of the Washington, D.C. embassy building.

There has been no practical solution suggested on a way to destroy, or remove the electronic bugs in the United States' new Moscow embassy which does not involve destruction of the building.

(2) Description of the prior art

It is known that electromagnetic pulses (EMP) if large enough will disable or destroy electrical devices of all types. The military has suggested the use of such EMP devices to destroy enemy military equipment. The electromagnetic pulse produced by a thermonuclear explosion is also known to destroy electrical devices within which are within range of the EMP.

The field of microwave heating and applications teaches that microwave energy may be used for heating materials and cooking of foods. The art of microwave heating is concerned with constructive uses of microwaves, and does not contemplate using microwave to destroy the item under treatment.

SUMMARY OF THE INVENTION

This invention will provide an inexpensive and efficient way to destroy electronic bug devices which are known to be in the concrete of the new United States embassy in Moscow. The concrete is subjected to a microwave field which may be produced by any convenient means, but which is portable enough to be moved through a building.

It is an object of this invention to provide a reasonable and inexpensive means to treat any building or structure which is known to contain, or which is suspected of containing electronic bugs. Sufficient power levels can be used which will kill known electronic devices embedded in building structures.

It is an object of this invention to provide a means of assuring the occupant of a building that there are no operative electronic bugs within its structure.

The electronic bugs are known to be small and to be constructed with microelectronic chips and circuits. It is not necessary to know exactly what part of the chip, device, circuit or power supply is destroyed by the microwave treatment. It is only necessary to sense the output from the electronic bugs and to determine if they are still operational (not killed). As experience is gained with particular power levels, frequencies, and structures, it may be practical to dispense with actually listening because the bugs will be known to be killed based upon experience with other similar structures.

The ability of the microwave energy to create heat and steam in concrete structures may also be used to create ions within the structure by generating steam. Once it is known that the structure is ionized, then an electric current may be passed through the structure to kill the bugs within.

BRIEF DESCRIPTION OF THE DRAWING

FIG. 1 a diagram of the structure of a typical microwave applicator for killing bugs in a structure.

FIG. 2 shows a method of killing electronic bugs which passes an electric current through the structure.

DETAILED DESCRIPTION OF THE PREFERRED EMBODIMENT

In this invention, the electronic bugs are to be killed by electromagnetic energy. It has been found that microwave frequencies are effective. It is not necessary that the person operating the device know what part of the device is destroyed or rendered inoperative. An attack with microwave may destroy connections to the power supply, the chips which comprise the circuits, portions of circuits or any other functional element of the bug which is caused to fail by subjection to microwave energy. It is not material whether a component fails because of excessive heat, excessive induced currents, or any other physical effect.

In experimental testing with microelectronic transmitters and receivers that are obtainable from sources such as Radio Shack it has been observed that when such a device is 5 inches in a rock gravel mixture that the device can be easily be destroyed by the application of microwave energy. When such a test circuit in gravel was subjected to microwave energy of as low as 5 watts and frequencies of 915 or 2450 mega Hertz that the devices tested were killed. It is anticipated that continuous power levels in excess of 60 kilowatts can be used to penetrate concrete and destroy electronic bugs at depths of several feet while there is metal reinforcement in the concrete.

This invention also contemplates the use of short bursts or pulses of microwave energy which may have power levels of up to 5 mega watts.

FIG. 1 depicts a typical microwave structure 10 and a section of a reinforced concrete structural member 11. A microwave generator consisting of a magnetron and a suitable power supply is shown at 12. The power supply may be a motor generator set or a connection to an available power supply from an electric utility.

A wave guide 14 connects the microwave generator 12 to a microwave applicator 16. The wave guide 14 is shown as a straight connection, but it is contemplated that it may have a bend, or be made or a material which will allow the applicator 16 to move with respect to the microwave generator 12.

The structural member 11 to be treated is shown as a section of a vertical support member, but it may be any part of a building such as a floor, support column or beam.

The applicator 16 is cavity of appropriate geometry to reflect the microwave energy into the open space beneath the cavity which has an open bottom. Typically this cavity is aluminum, stainless steel or a non-magnetic metal.

A trap or choke 18 with an appropriate reflecting and/or absorption property to minimize unwanted broadcasting of the microwave energy may be used. Such structures are conventional and commonly used in microwave applicators and heaters.

A reflecting surface 20 may be used to cover a substantial portion of the structural member during treatment. This may be a metallic surface such as aluminum foil on the surface of the member 11. The purpose of the surface 20 is to confine the microwave energy within the structural member 11, and for this reason it may extend for some distance on the side of the beam where the applicator 16 is placed, on the top of the beam as shown, and on the reverse side if there is any concern about leakage of energy form this surface. The reflecting surface also acts to concentrate the microwave energy within the area of the structure to be treated.

The structure under treatment 11 is shown with numerous electronic bug devices 1,2,3,4, and 5 embedded in it. These devices may be any electronic device which is capable of picking up sound waves, electromagnetic energy or any other human or machine activity which may transmit energy which contains information. Typical devices are based upon micro chip and micro circuit technology which are very small, and which are vulnerable to microwave energy bursts because their small size makes them incapable of withstanding high intensity energy bursts. Typical devices are microphone or vibration detectors which sense speech and sounds and electromagnetic sensors which can pick up radio frequency information signals, radiation from computers, from telephones, and other electronic equipments.

Since the bugs 1-5 are small, it is possible to have as many as 100 bugs per cubic yard of concrete without affecting the structural characteristics of the structural member 11. With such a large number of bugs in a structure, it is physically impossible to remove them from the structure without destroying the structural member and all parts of the building which contain a high concentration of bugs. The United States embassy in Moscow is believed to contain a vast number of such electronic bugs, and it has been suggested that the entire structure be demolished and a new one built.

The structural member 11 will usually contain steel reinforcement 22 which is necessary for strength. The steel reinforcement will also interfere with microwave attacks on the bugs because it will reflect the energy. When such steel is present it may be defeated by using electromagnetic waves of a frequency which will heat and thus render the members non-magnetic and non conductive and thus ineffective as a shield for the microwave energy. Some electronic bugs may include a cage or magnetic shield to protect them from radiation and destruction. These devices may be disabled by rendering the cage non-magnetic and then subjecting them to microwave treatment to kill them.

The electronic bugs may also be killed by raising the temperature of the structural member and/or the bug to a high level which will destroy the bug by use of radio frequency radiation.

In another embodiment of this invention, the concrete may be subjected to radio frequency energy to generate steam within the structure from the concrete chemicals. This steam will provide ionization within the beam which will conduct electricity. Therefore, high electrical currents may be passed through the beam which will kill the bugs by induction, heat, or arcing within the device. Ionization may also be introduced into the beam by leaching an ionic fluid into the beam if it can absorb moisture.

In treatment of buildings it is also important to provide protection for the personnel who are operating the equipment. Protective radio frequency reflective clothing, head, foot and hand coverings may be used to protect operating personnel or others who may be in the treatment area. Typically this is a natural or synthetic fiber with a fine metal filament, woven or knitted into it to create a barrier to the passage or radio frequency energy.

Radio frequency radiation and more particularly micro wave radiation may also be used to break down the bonding structure of a structural member. If this approach is used, the bugs located within the structure will become accessible and can thus be removed or destroyed in any convenient manner.

The invention contemplates the use of microwave energy, but it is to be understood that any radio frequency energy may be considered for this application. The use of other frequencies may disable a circuit if it or a component is tuned to that frequency either intentionally or inadvertently. Therefore, any radio frequency and intensity should be considered when considering use of this method of killing bugs in locations which are normally inaccessible such as building structural members.

In another embodiment of the invention, there may be ions introduced into the structural member as shown in FIG. 2. Ions may be introduced by treatment with microwave energy until water vapor is created within the structure as indicated by 40. In another approach, ions may be introduced into the structure by leaching a solution containing ionic materials such as a salt into the structure as indicated at 50. Once the structure is known to have sufficient ions to carry an electric current, a current from a source 52 may be passed through the structure as illustrated with plates 54 and 56. In this embodiment, the electronic bugs 1,2,3 etc are destroyed by the flow of a large current which will over heat the devices, which may cause large destructive currents within the devices, and which may destroy connections, junctions, or chip structure.

Although this invention has been shown and described with respect to the best mode embodiment thereof, it should be understood by those skilled in the art that various other changes, additions, and omissions may be made therein without departing from the scope and spirit of the invention. In particular while the best mode has been illustrated with specific reference to microwave energy, it applies equally to other radio frequencies which exhibit an ability to kill electronic bugs within structures.

I claim:

1. A method of killing an electronic device which is embedded in a concrete structure which cannot be economically opened up to gain access to said electronic device comprising the steps of:

placing a source of radio frequency energy in a location outside said concrete structure which permits said radio frequency energy to pass into said structure and reach said electronic device;

wherein said radio frequency is a microwave frequency which will penetrate to said electronic device and which will kill said device by causing failure of at least one electronic component of said device.

2. The method of claim 1 wherein said device is a listening device which transmits to a receiver by means of electromagnetic radiation.

3. The method of claim 2 wherein said device transmits by means of radio frequency signals.

4. The method of claim 2 wherein said device is a pickup for electronic leakage signals from electronic devices located in an area that is receivable from said device.

5. The method of claim 4 wherein said electronic devices include typewriters, computers, communication means, transmitters, telefax machines, and other information handling equipment.

6. The method of claim 4 wherein said device is a pickup for light modulation signals.

7. The method of claim 1 wherein said source of radio frequency energy is a microwave generator and a wave guide which directs said energy into said structure.

8. The method of claim 1 wherein said source of radio frequency is a frequency from 400 megacycles to 3000 megacycles.

9. The method of claim 1 wherein said source of radio frequency has a means for preventing unwanted radio frequency transmissions.

10. The method of claim 9 wherein said means for preventing is a microwave absorber.

11. The method of claim 1 wherein said radio frequency source is a point source from which radio frequency energy expands in three dimensions.

12. The method of claim 1 wherein said device has a microchip.

13. The method of claim 1 wherein said radio frequency energy is directed towards said device to be killed.

14. The method of claim 1 wherein said radio frequency is a microwave frequency which is adjusted in power level and frequency which will achieve selective killing of electronic devices.

15. The method of claim 1 where in said radio frequency energy penetrates shielding and reinforcing rods and which renders said shielding and reinforcing rods non-magnetic and non-conductive which will expose said electronic device to said killing radio frequency signal.

16. The method of claim 1 where in said radio frequency signal heats the encapsulating environment of said electronic device to a temperature which will kill said device.

17. The method of claim 1 where in said source is a continuous wave source with power levels of 5 watts to 60 kilowatts.

18. The method of claim 1 wherein said source is a pulse having a peak power which is as high as 5 mega watts.

19. The method of claim 18 wherein said pulse has a duration of several microseconds to several seconds.

20. The method in accordance with claim 1 wherein said radio frequency is between 400 and 3000 megacycles and at a power level of 5 to 100 kilowatts continuous wave.

* * * * *